US008789388B2

(12) United States Patent
Lee et al.

(10) Patent No.: US 8,789,388 B2
(45) **Date of Patent: *Jul. 29, 2014**

(54) REFRIGERATOR WITH ICEMAKER COMPARTMENT HAVING AN IMPROVED AIR FLOW

(71) Applicant: Samsung Electronics Co., Ltd., Suwon-si (KR)

(72) Inventors: Jong Dal Lee, Gwangju (KR); Jae Hoon Lim, Suwon (KR); Myung Hoon Cho, Suwon (KR); Seung Tae Lim, Gwangju (KR); Dong Nyeol Ryu, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/709,633

(22) Filed: Dec. 10, 2012

(65) Prior Publication Data

US 2013/0098097 A1 Apr. 25, 2013

Related U.S. Application Data

(63) Continuation of application No. 11/878,601, filed on Jul. 25, 2007, now Pat. No. 8,336,330.

(30) Foreign Application Priority Data

Aug. 11, 2006 (KR) ..... 10-2006-0076454

(51) Int. Cl.
*F25D 3/02* (2006.01)

(52) U.S. Cl.
USPC ..... 62/425; 62/344; 62/420

(58) Field of Classification Search
CPC ..... F24F 13/04; F25D 17/08; F25D 2317/067
USPC ..... 62/344, 420, 425, 442
See application file for complete search history.

(56) References Cited

U.S. PATENT DOCUMENTS 474,115 A * 5/1892 Schulze ..... 449/7
2,959,025 A * 11/1960 Morrison ..... 62/62

(Continued)

FOREIGN PATENT DOCUMENTS

KR 10-2005-0028685 3/2005
KR 10-2005-0094671 9/2005

OTHER PUBLICATIONS

U.S. Office Action in copending U.S. Appl. No. 11/878,601 mailed Jul. 20, 2009.
U.S. Office Action in copending U.S. Appl. No. 11/878,601 mailed Feb. 4, 2010.

(Continued)

*Primary Examiner* — Lakiya Rogers
(74) *Attorney, Agent, or Firm* — Staas & Halsey LLP

(57) ABSTRACT

A refrigerator with an ice making device. The refrigerator includes a body defined with a refrigerating compartment, a freezing compartment, and an ice making compartment, the ice making compartment arranged in the refrigerating compartment while being thermally insulated from the refrigerating compartment, a first evaporator arranged in the refrigerating compartment, a second evaporator arranged in the freezing compartment, a refrigerating duct for circulating cold air from the first evaporator to the refrigerating compartment, a freezing duct for circulating cold air from the second evaporator to the freezing compartment, and an ice making flow passage for communicating the second evaporator and the ice making compartment. The second evaporator, ice making compartment, and ice making flow passage form a closed circuit such that the cold air in the ice making compartment does not enter the refrigerating compartment.

8 Claims, 5 Drawing Sheets

(56) References Cited

U.S. PATENT DOCUMENTS

| | | | |
|---|---|---|---|
| 6,327,867 | B1 | 12/2001 | Hyodo et al. |
| 7,076,967 | B2 | 7/2006 | Lee et al. |
| 7,185,507 | B2 | 3/2007 | Maglinger et al. |
| 7,188,479 | B2 | 3/2007 | Anselmino et al. |
| 7,228,703 | B2 | 6/2007 | Kim et al. |
| 7,272,949 | B2 | 9/2007 | Lee et al. |
| 2006/0086128 | A1 | 4/2006 | Maglinger et al. |
| 2006/0090496 | A1 | 5/2006 | Adamski et al. |

OTHER PUBLICATIONS

U.S. Office Action in copending U.S. Appl. No. 11/878,601 mailed Jan. 17, 2012.
U.S. Notice of Allowance in copending U.S. Appl. No. 11/878,601 mailed Aug. 31, 2012.
U.S. Appl. No. 11/878,601, filed Jul. 25, 2007, Jong Dal Lee, Samsung Electronics Co., Ltd.
Korean Office Action mailed Dec. 21, 2012 for corresponding Korean Application No. 10-2006-0076454.

* cited by examiner

REFRIGERATOR WITH ICEMAKER COMPARTMENT HAVING AN IMPROVED AIR FLOW

CROSS-REFERENCE TO RELATED APPLICATIONS

This application is a continuation of U.S. application Ser. No. 11/878,601, filed on Jul. 25, 2007, which claims the benefit of Korean Patent Application No. 10-2006-0076454 filed on Aug. 11, 2006 in the Korean Intellectual Property Office, the disclosures of which are incorporated herein by reference.

BACKGROUND

1. Field

The present invention relates to a refrigerator. More particularly, to a refrigerator having an ice making device.

2. Description of the Related Art

Generally, a conventional refrigerator having a freezing compartment and a refrigerating compartment, into which cold air heat-exchanged at an evaporator is introduced, and is provided with a machinery compartment arranged at a rear side of the freezing compartment or refrigerating compartment beneath the freezing compartment or refrigerating compartment, to install a compressor and a condenser. In conventional refrigerator, the refrigerating compartment can store food in a fresh state at a temperature of about 3 to 5° C., and the freezing compartment can store food in a frozen state at a sub-zero temperature for a prolonged period of time.

One type of conventional refrigerator includes an upper compartment functioning as a refrigerating compartment, to store beverage or foods to be stored for a short period of time, and a lower compartment functioning as a freezing compartment. This type of conventional refrigerator also includes an ice making device provided with a dispenser arranged at a front side of a door of the ice making device, in order to allow the user to conveniently take ice out of the ice making device.

An example of such a conventional refrigerator is disclosed in U.S. Patent Publication No. 2006/0090496. The disclosed refrigerator includes a lower compartment functioning as a freezing compartment and an upper compartment functioning as a refrigerating compartment. An ice making region is defined at an upper or lower corner of the refrigerating compartment.

When the ice making compartment is defined at an upper corner of the refrigerating compartment, an air duct is provided to guide cold air present in the freezing compartment defined at a lower portion of the refrigerator to the ice making region, and thus supplies cold air required to make ice.

Although not disclosed in the above-mentioned publication, a communication passage is formed between the ice making region and the refrigerating compartment, in order to discharge cold air introduced into the ice making region to the refrigerating compartment after making of ice using the cold air, and thus to maintain the refrigerating compartment at an appropriate refrigerating temperature. The cold air flows toward an evaporator provided at the freezing compartment, and is then guided to the ice making region via the air duct after being heat-exchanged at the evaporator. Thus, the cold air is circulated. A damper is provided in the communication passage between the ice making region and the refrigerating compartment. In accordance with opening/closing of the damper, the ice making region and refrigerating compartment are maintained at desired temperatures, respectively.

However, conventional refrigerators including the refrigerator disclosed in the above-mentioned publication perform supply of cold air for maintaining the freezing compartment in a desired freezing state, supply of cold air for making ice in the ice making region, and supply of cold air for maintaining the refrigerating compartment in a desired refrigerating state. For this reason, the supply of cold air may be insufficient, thereby causing a degradation in ice making performance.

When the door of the refrigerating compartment is frequently opened and closed, the temperature of cold air present in the refrigerating compartment increases. The temperature-increased cold air is heat-exchanged through an evaporator after being circulated into the freezing compartment. In this case, the heat-exchanged cold air exhibits a relatively high temperature because the temperature of the cold air passing the evaporator is relatively high. The cold air, which has a relatively high temperature, degrades the ice making performance.

Furthermore, the freezing compartment, refrigerating compartment, and ice making region communicate with one another. As a result, the smell of food stored in one compartment is diffused to the remaining compartments. In particular, when the smell of food stored in the refrigerating compartment is diffused to the ice making region, there is a problem in that the food smell is absorbed into the ice made in the ice making region.

During an ice making operation, the damper installed in the communication passage may be maintained in a closed state. In this case, however, there is a problem in that it is impossible to supply cold air simultaneously to the three compartments, namely, the freezing compartment, refrigerating compartment, and ice making region.

SUMMARY

Accordingly, it is an aspect of the present invention to provide a refrigerator having a structure capable of achieving an enhancement in ice making performance.

It is another aspect of the present invention to provide a refrigerator having a structure capable of preventing the smell of food stored in a refrigerating compartment from being introduced into an ice making compartment or a freezing compartment.

It is another aspect of the present invention to provide a refrigerator having a structure capable of supplying cold air simultaneously to a refrigerating compartment, a freezing compartment, and an ice making compartment.

Additional aspects and/or advantages will be set forth in part in the description which follows and, in part, will be apparent from the description, or may be learned by practice of the invention.

These and/or other aspects of the present invention are achieved by providing a refrigerator comprising a body defined with a refrigerating compartment, a freezing compartment, and an ice making compartment, the ice making compartment arranged in the refrigerating compartment while being thermally insulated from the refrigerating compartment, the refrigerator including a first evaporator arranged in the refrigerating compartment, a second evaporator arranged in the freezing compartment; a refrigerating duct for circulating cold air from the first evaporator to the refrigerating compartment, a freezing duct for circulating cold air from the second evaporator to the freezing compartment, and an ice making flow passage for communicating the second evaporator and the ice making compartment, wherein the second evaporator, the ice making compartment, and the ice making flow passage form a closed circuit such that the cold air in the ice making compartment does not enter the refrigerating compartment.

According to an aspect of the present invention, the refrigerating compartment is arranged above the freezing compartment.

According to an aspect of the present invention, the ice making compartment is arranged above the refrigerating compartment.

According to an aspect of the present invention, the ice making flow passage includes a supply passage for guiding cold air heat-exchanged at the second evaporator to the ice making compartment, and a return passage for guiding the cold air in the ice making compartment to an inlet side of the second evaporator.

According to an aspect of the present invention, the supply passage and the return passage are provided at a rear wall of the body.

According to an aspect of the present invention, the ice making compartment includes an inlet for communicating the ice making compartment to the supply passage and an outlet for communicating the ice making compartment to the return passage.

According to an aspect of the present invention, the inlet and the outlet is arranged at a rear side of the ice making compartment.

According to an aspect of the present invention, the refrigerator further includes an ice making device arranged in the ice making compartment, to produce and store ice, the ice making device includes an ice maker for making ice, an ice bank arranged at one side of the ice maker, to store ice fed from the ice maker, and an auger arranged in the ice bank, to feed ice.

According to an aspect of the present invention, the refrigerator further includes at least one refrigerating compartment door arranged at a front side of the refrigerating compartment, to open or close the refrigerating compartment, and a dispenser arranged at one of the at least one refrigerating compartment door, to dispense ice.

According to an aspect of the present invention, the ice making device further includes an ice crusher for crushing ice.

It is another aspect of the present invention to provide a refrigerator including a body having a refrigerating compartment, a freezing compartment, and an ice making compartment, the refrigerating compartment includes a refrigerating space forming a storing space, and a first evaporator for generating cold air to be introduced into the refrigerating space, the freezing compartment includes a freezing space forming a storing space, and a second evaporator for generating cold air to be introduced into the ice making compartment and into the freezing space; the body includes an ice making flow passage for circulating cold air between the second evaporator and the ice making compartment, and the ice making flow passage includes a supply passage for guiding cold air heat-exchanged at the second evaporator to the ice making compartment, and a return passage for guiding the cold air in the ice making compartment to an inlet side of the second evaporator, such that the ice making flow passage forms a closed circulation flow passage.

According to an aspect of the present invention, the refrigerating compartment further includes a refrigerating duct defined with a refrigerating flow passage for circulating cold air between the refrigerating space and the first evaporator. The freezing compartment further includes a freezing duct defined with a freezing flow passage for circulating cold air between the freezing space and the second evaporator.

According to an aspect of the present invention, the refrigerating compartment further includes a first blowing fan arranged in the refrigerating duct, to forcibly supply cold air to the refrigerating space.

According to an aspect of the present invention, the freezing compartment further includes a second blowing fan arranged in the freezing duct, to forcibly supply cold air to the freezing space.

According to an aspect of the present invention, the refrigerator further includes a third blowing fan arranged in the supply passage adjacent to the second evaporator, to forcibly supply the cold air from the second evaporator to the ice making compartment.

According to an aspect of the present invention, the freezing duct includes a guide passage for communicating the supply passage and the second evaporator.

According to an aspect of the present invention, the refrigerator further includes a fourth blowing fan arranged in the guide passage, to forcibly supply the cold air from the second evaporator to the ice making compartment.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
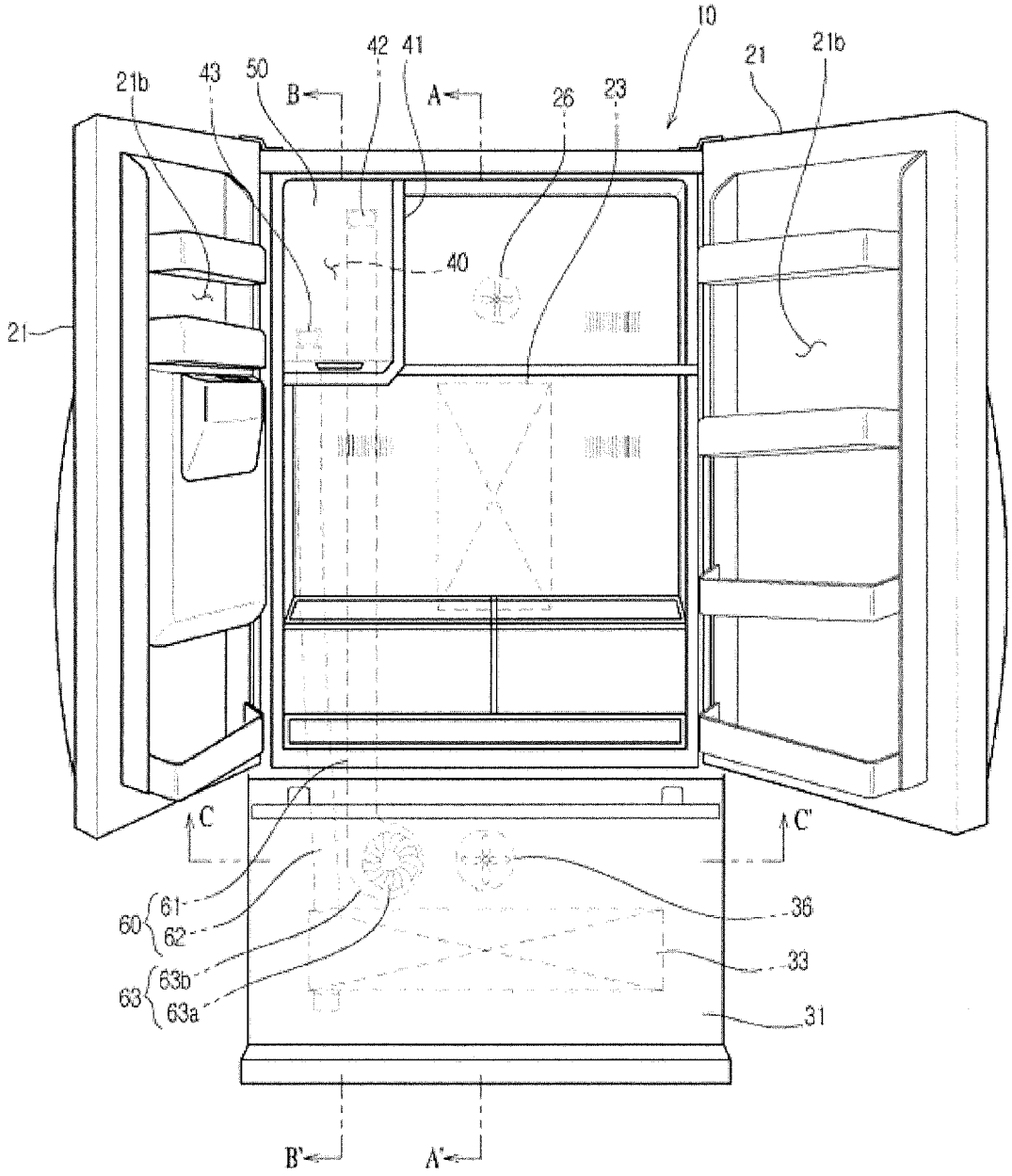
FIG. 1 is a perspective view illustrating an appearance of a refrigerator according to an embodiment of the present invention in an opened state of a refrigerating compartment door.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
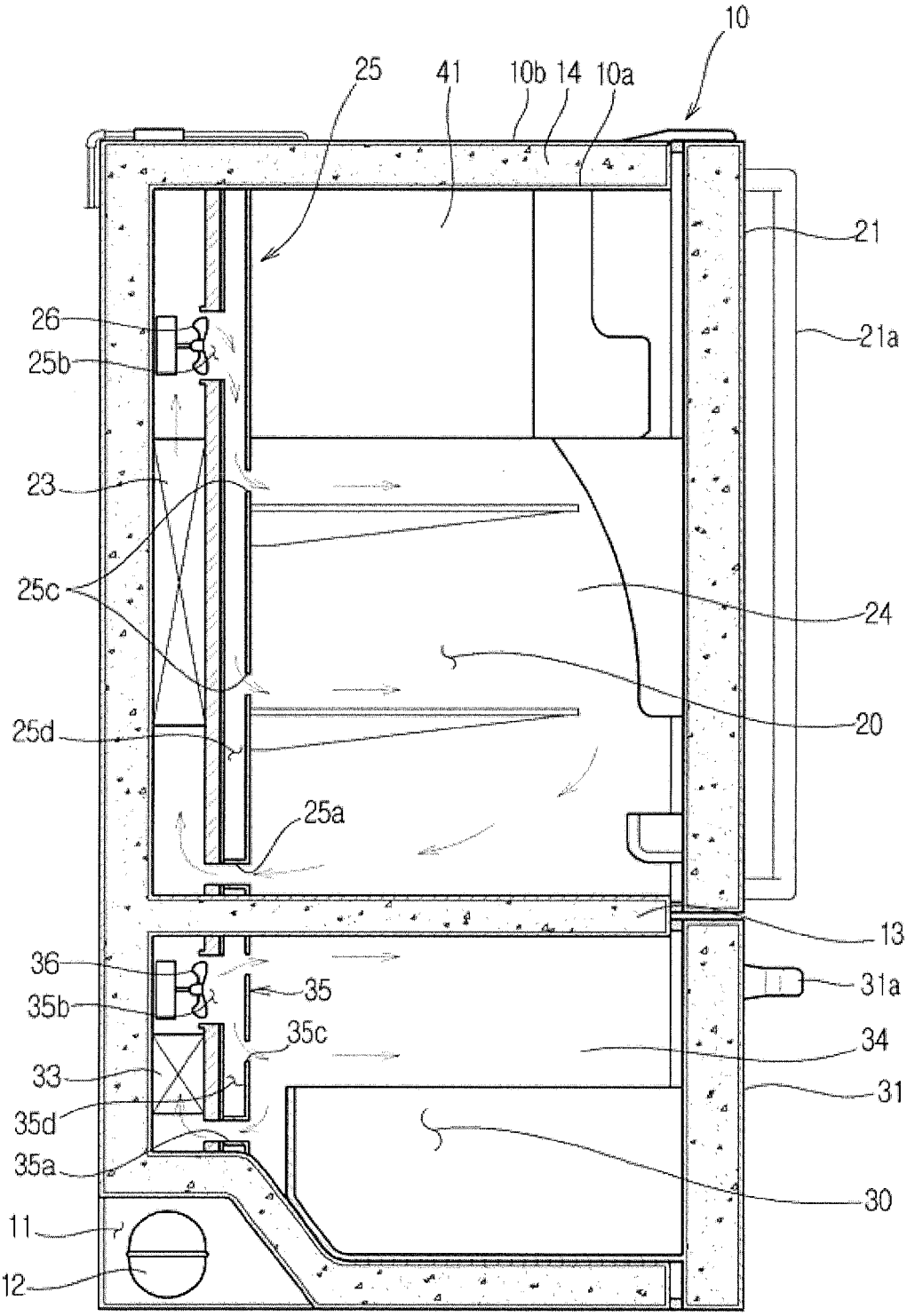
FIG. 2 is a cross-sectional view taken along a line A-A' in FIG. 1 in a closed state of the refrigerating compartment door of FIG. 1.
Figure 3:
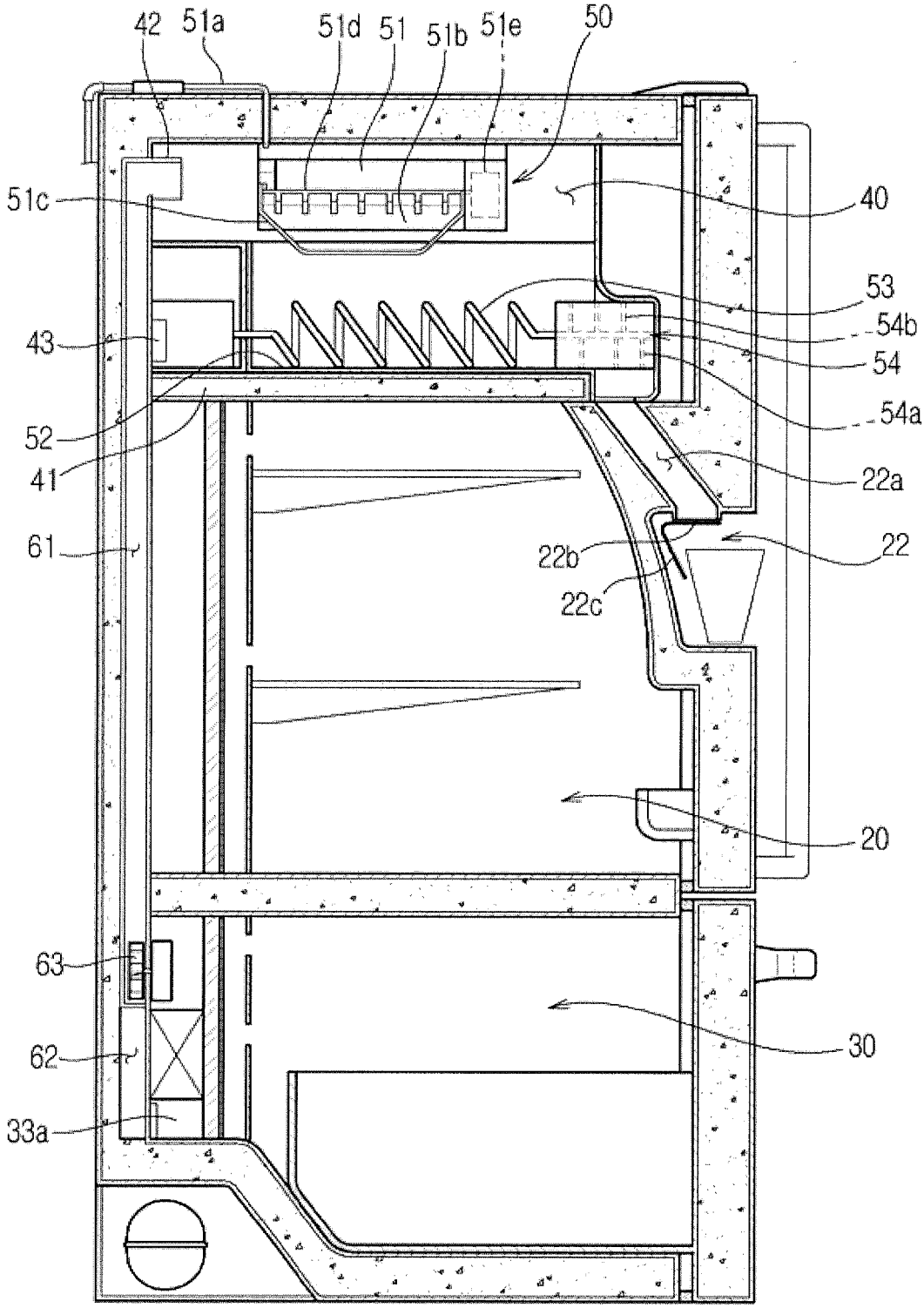
FIG. 3 is a cross-sectional view taken along a line B-B' of FIG. 1 in the closed state of the refrigerating compartment door of FIG. 1.

FIG. 1 is a perspective view illustrating an appearance of a refrigerator according to an embodiment of the present invention in an opened state of a refrigerating compartment door. FIG. 2 is a cross-sectional view taken along a line A-A' in FIG. 1 in a closed state of the refrigerating compartment door of FIG. 1. FIG. 3 is a cross-sectional view taken along a line B-B' of FIG. 1 in the closed state of the refrigerating compartment door of FIG. 1.

As shown in FIGS. 1 and 2, the refrigerator according to the illustrated embodiment of the present invention comprises a body 10. The body 10 comprises a refrigerating compartment 20 defined at an upper portion of the body 10, a freezing compartment 30 defined beneath the refrigerating compartment 20, and an ice making compartment 40 defined above the refrigerating compartment 20 by insulating walls 41. The refrigerator also comprises doors 21 and 31 respectively arranged at front sides of the refrigerating and freezing compartments 20 and 30, and an ice making device 50 arranged in the ice making compartment 40, to make and store ice.

The refrigerator according to the illustrated embodiment of the present invention also comprises elements for constituting a refrigerant cycle, for example, a compressor 12, a condenser (not shown), an expander (not shown), and evaporators 23 and 33.

Electric or mechanical elements are arranged in a machinery compartment 11 defined in a lower portion of the body 10 at a rear side of the body 10. For example, the compressor 12 is installed in the machinery compartment 11. The freezing compartment 30 is arranged above the machinery compartment 11. The refrigerating compartment 20 is arranged above the freezing compartment 30. The refrigerating compartment 20 and freezing compartment 30 are partitioned by a horizontal partition wall 13. A foam material 14 is filled in a space defined between inner and outer cases 10*a* and 10*b* of the body 10, in order to achieve thermal insulation.

A freezing compartment door 31, which is of a sliding type, is provided at a front side of the freezing compartment 30. A pair of refrigerating compartment doors 21, which are of a side-by-side type, are provided at a front side of the refrigerating compartment 20.

The doors 21 and 31 are provided with door handles 21*a* or 31*a*, respectively. Receiving spaces 21*b* are provided at an inner side of each refrigerating compartment door 21. A dispenser 22 is mounted to an outer surface of the left refrigerating compartment door 21, to dispense ice made by the ice making device 50. A cup lever 22*c* is provided at the dispenser 22, to open a damper 22*b* provided at an outer end of an ice discharge passage 22*a* (see FIG. 3).

The refrigerating compartment 20, which is defined at the upper portion of the body 10, comprises a first evaporator 23 arranged at the rear side of the refrigerating compartment 20, to generate cold air to be supplied to the interior of the refrigerating compartment 20, a refrigerating space 24 for storing food, etc., a refrigerating duct 25 partitioning the refrigerating space 24 from the first evaporator 23, and circulating cold air heat-exchanged at the first evaporator 23 into the refrigerating space 24, and a first blowing fan 26 arranged in the refrigerating duct 25, to forcibly circulate the cold air.

A first inlet 25*a* is formed at a lower portion of the refrigerating duct 25, to guide cold air from the refrigerating space 24 toward the first evaporator 23. A first blowing port 25*b* is provided at an upper portion of the refrigerating duct 25, to discharge cold air introduced through the first inlet 25*a* into the refrigerating space 24 after being subjected to heat exchange while passing the first evaporator 23. The first blowing fan 26 is arranged at the first blowing port 25*b*, in order to forcibly supply the heat-exchanged cold air to the refrigerating space 24.

An appropriate number of spaced first outlets 25*c* are formed at a front side of the refrigerating duct 25 such that the cold air emerging from the first blowing port 25*b* by the first blowing fan 26 is discharged into the refrigerating space 24 in a uniformly-distributed manner. A refrigerating flow passage 25*d* is defined in the refrigerating duct 25, to guide the cold air introduced through the first blowing port 25*b* to the first outlets 25*c*.

Accordingly, the cold air present in the refrigerating space 24 flows toward the first evaporator 23 through the first inlet 25*a*. After being subjected to heat exchange while passing the first evaporator 23, the cold air is introduced into the refrigerating flow passage 25*d* via the first blowing fan 26. The cold air introduced into the refrigerating flow passage 25*d* is discharged into the refrigerating space 24 through the first outlets 25*c*. Thus, the circulation of cold air in the refrigerating compartment 20 is carried out in a closed circulation manner. Accordingly, the cold air present in the refrigerating compartment 20 is introduced into neither the freezing compartment 30 nor the ice making compartment 40. Similarly, the cold air present in the freezing compartment 30 or ice making compartment 40 is not introduced into the refrigerating compartment 20.

The freezing compartment 30, which is arranged beneath the refrigerating compartment 20, comprises a second evaporator 33 arranged at the rear side of the freezing compartment 30, to generate cold air to be supplied to the interior of the freezing compartment 30, a freezing space 34 for storing food, etc. in a frozen state, a freezing duct 35 partitioning the freezing space 34 from the second evaporator 33, and circulating cold air generated in accordance with heat exchange carried out by the second evaporator 33 into the freezing space 34, and a second blowing fan 36 arranged in the freezing duct 35, to forcibly circulate the cold air.

A second inlet 35*a* is formed at a lower portion of the freezing duct 35, to guide cold air from the freezing space 34 toward the second evaporator 33. A second blowing port 35*b* is provided at an upper portion of the freezing duct 35, to discharge cold air introduced through the second inlet 35*a* into the freezing space 34 after being subjected to heat exchange while passing the second evaporator 33. The second blowing fan 36 is arranged at the second blowing port 35*b*, in order to forcibly supply the heat-exchanged cold air to the freezing space 34.

A plurality of spaced second outlets 35*c* are formed at a front side of the freezing duct 35 such that the cold air emerging from the second blowing port 35*b* by the second blowing fan 36 is discharged into the freezing space 34 in a uniformly-distributed manner. A freezing flow passage 35*d* is defined in the freezing duct 35, to guide the cold air introduced through the second blowing port 35*b* to the second outlets 35*c*.

As described above, the ice making compartment 40 is defined above the refrigerating compartment 20 by the insulating walls 41. In the ice making compartment 40, the ice making device 50, which produces and stores ice, is arranged. Since the ice making compartment 40 is arranged at one side of the refrigerating compartment 20, heat exchange occurs between the ice making compartment 40 and the refrigerating compartment. In order to avoid a degradation in ice making performance due to such heat exchange, the insulating walls 41 of the ice making compartment 40 are made of a thermal insulating material. According to an embodiment of the present invention, the insulating walls 41 are formed integrally with the body 10 when a foaming process is carried out to form the body 10.

For example, the ice making device 50 included in the refrigerator according to the illustrated embodiment of the present invention comprises an ice maker 51 for making ice, an ice bank 52 arranged beneath the ice maker 51, to store ice separated from the ice maker 51, an auger 53 arranged in the ice bank 52, to move the ice stored in the ice bank 52 to the dispenser 22, and an ice crusher 54 arranged at an end of the auger 53, to selectively crush ice in accordance with a user's desire.

The ice maker 51 comprises a water supply pipe 51*a* for supplying water, a tray 51*c* formed with a plurality of ice receiving spaces 51*b*, in which water is stored and frozen, an ice separating member 51*d* for separating ice from the ice receiving spaces 51*b*, and a drive motor 51*e* for driving the ice separating member 51*d*. The ice maker 51 extends considerably in a depth direction of the ice making compartment 40. Also, the tray 51*c* of the ice maker 51 is fixed to the upper surface of the ice making compartment 40. Thus, it is possible to reduce the volume of the ice making device 50 installed in the ice making compartment 40.

The ice bank 52, which is arranged beneath the ice maker 51, stores ice separated from the tray 51*c* of the ice maker 51. The auger 53, which is arranged in the ice bank 52, has a spiral shape. Accordingly, as the auger 53 rotates, the ice stored in the ice bank 52 is moved to the dispenser 22.

The ice crusher 54, which is mounted to the outer end of the auger 53 to crush ice, includes a fixed blade 54*a* and rotating blades 54*b*. Accordingly, the ice crusher 54 can feed ice cubes or ice particles to the dispenser 22 through the ice discharge passage 22*a* in accordance with a user's selection.

An inlet 42 is formed at an upper side of a rear surface of the ice making compartment 40 where the ice making device 50 is mounted, to supply, to the ice making compartment 40, cold air heat-exchanged while passing the second evaporator 33. An outlet 43 is formed at a lower side of the rear surface of the ice making compartment 40, to circulate the cold air introduced into the ice making compartment 40 toward an inlet side 33*a* of the second evaporator 33.

In the refrigerator according to the illustrated embodiment of the present invention, an ice making flow duct 60 is provided at the body 10, to circulate cold air through the ice making compartment 40 and second evaporator 33. The ice making flow duct 60 is arranged in the rear wall of the body 10 between the inner case 10*a* and the outer case 10*b*. The ice making flow duct 60 is fixed to the rear wall of the body 10 by filling a foam material 14 into a space defined between the ice making flow duct 60 and the rear wall of the body 10.

Figure 4:
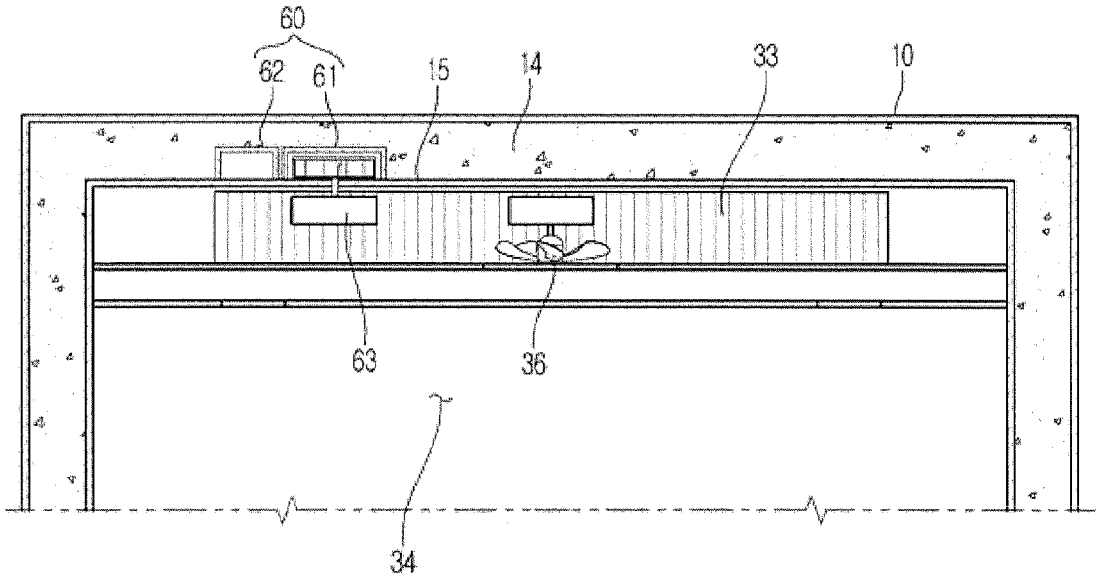
FIG. 4 is a cross-sectional view taken along a line C-C' of FIG. 1.

As shown in FIGS. 3 and 4, the ice making flow duct 60 comprises a supply duct 61 for guiding, to the ice making compartment 40, cold air subjected to heat exchange while passing the second evaporator 33, and a return duct 62 for guiding the cold air present in the ice making compartment 40 to the inlet side 33*a* of the second evaporator 33.

The supply duct 61 comprises a first end connected to the inlet 42 of the ice making compartment 40. A third blowing fan 63 is arranged at a second end of the supply duct 61 arranged above the second evaporator 33, to forcibly supply, to the ice making compartment 40, cold air subjected to heat exchange while passing the second evaporator 33. According to an embodiment of the present invention, the third blowing fan 63 is arranged adjacent to the second evaporator 33. Where the third blowing fan 63 is arranged at such a position, it is possible to more efficiently supply cold air to the ice making compartment 40, as compared to the case in which the third blowing fan 63 is arranged in the supply duct 61 at a position adjacent to the ice making compartment 40.

For the third blowing fan 63, any one of a cross-flow fan and an axial flow fan may be used. According to an embodiment of the present invention, a cross-flow fan 63*a* is used for the third blowing fan 63. In this case, the third blowing fan 63 includes a fan casing 63*b* for guiding cold air. The third blowing fan 63 may be fixedly mounted to the freezing duct 35 or to the rear surface of the freezing compartment 30.

Cold air emerging from the second evaporator 33 after being heat-exchanged is introduced into the ice making compartment 40 via the supply duct 61 by the third blowing fan 63. Thus, cold air is supplied to the ice making device 50 arranged in the ice making compartment 40. The cold air supplied to the ice making compartment 40, as described above, is guided to the inlet side 33*a* of the second evaporator 33 via the return duct 62. Thus, the cold air is circulated after being heat exchanged. In accordance with such a circulation procedure, cold air for making ice is supplied to the ice making compartment 40. In this case, the cold air circulating through the ice making flow duct 60 does not enter the refrigerating compartment 20 because the ice making flow duct 60 does not communicate with the refrigerating compartment 20. Similarly, there is no occasion that the cold air from the refrigerating compartment 20 enters the freezing compartment 30 or ice making compartment 40 via the ice making flow duct 60.

Thus, in the refrigerator according to the illustrated embodiment of the present invention, it is possible to supply cold air in a desired amount and at a desired temperature to the ice making compartment 40, irrespective of frequent opening/closing of the refrigerating compartment 20, namely, irrespective of the use of the refrigerating compartment 20 by the user. Accordingly, it is possible to achieve an enhancement in ice making performance.

Also, the circulation path of cold air in the refrigerating compartment 20 and the circulation path of cold air in the ice making compartment 40 do not communicate. Accordingly, it is possible to prevent the smell of food in the refrigerating compartment 20 from being diffused to the ice making compartment 40. In addition, there is an effect capable of introducing the heat-exchanged cold air simultaneously into the refrigerating space 24, freezing space 34, and ice making compartment 40.

Hereinafter, a refrigerator according to another embodiment of the present invention will be described.

Figure 5:
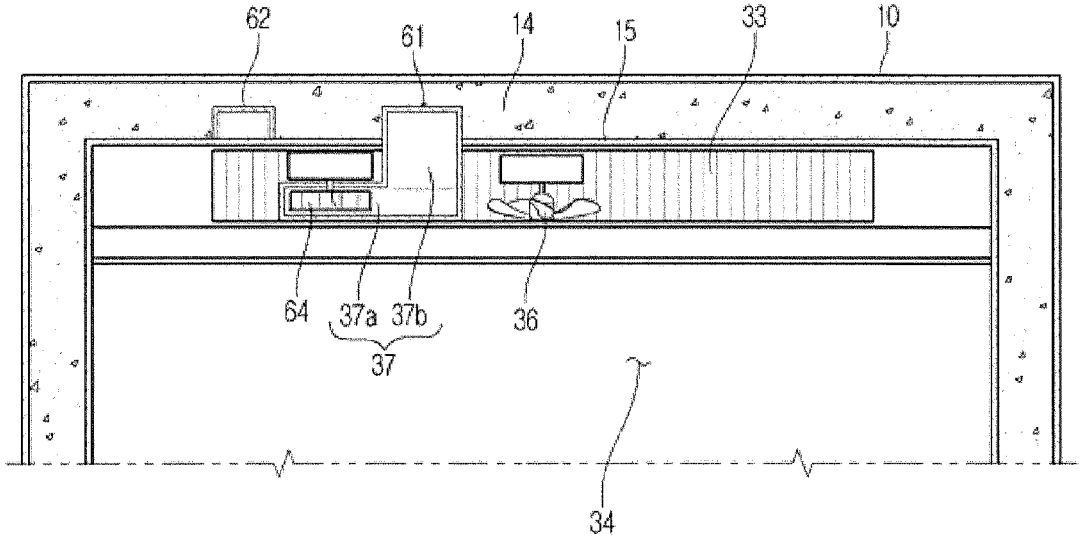
FIG. 5 is a cross-sectional view taken along the line C-C' of FIG. 1, illustrating a refrigerator according to another embodiment of the present invention.

In the refrigerator according to this embodiment, as shown in FIG. 5, a guide passage 37 is formed in the freezing duct 35, to communicate the supply duct 61 and second evaporator 33. The guide passage 37 comprises a first passage 37*a* for receiving cold air from the second evaporator 33, and a second passage 37*b* extending from the first passage 36*a* while being vertically bent from the first passage 36*a* toward a rear wall 15 of the body 10.

A fourth blowing fan 64 is arranged in the first passage 37*a*, to forcibly discharge cold air heat-exchanged at the second evaporator 33. The fourth blowing fan 64 comprises a cross-flow fan 64*a*, and a fan casing 64*b* for guiding cold air blown by the cross-flow fan 64*a*.

Accordingly, the cold air heat-exchanged while passing the second evaporator 33 is introduced into the first passage 37*a*, and is then discharged into the supply duct 61 via the second passage 37*b* in accordance with operation of the fourth blowing fan 64. The cold air introduced into the supply duct 61 is introduced into the ice making compartment 40, to provide a cooling effect for making ice. The cold air in the ice making compartment 40 is guided to the inlet side 33*a* of the second evaporator 33 via the return duct 62. Thus, circulation of cold air for making ice is achieved.

The above-described cold air circulation structure according to the present invention is applicable not only to a bottom freezer type refrigerator including an upper compartment functioning as a refrigerating compartment and a lower compartment functioning as a freezing compartment, but also to a top freezer type refrigerator including an upper compartment functioning as a freezing compartment and a lower compartment functioning as a refrigerating compartment and a side-by-side type refrigerator including freezing and refrigerating compartments respectively defined at opposite sides of a refrigerator body.

As apparent from the above description, in accordance with an embodiment of the present invention, evaporators are provided at refrigerating and freezing compartments, respectively, and cold air present in the freezing compartment is introduced into an ice making compartment. Accordingly, it is possible to achieve an enhancement in ice making performance, and to supply cold air simultaneously to the refrigerating and freezing compartments even during an ice making operation.

In addition, according to an embodiment of the present invention, it is possible to prevent the smell of food in the refrigerating compartment from being introduced into the ice making compartment because the refrigerating compartment does not communicate with the ice making compartment.

Although a few embodiments of the present general inventive concept have been shown and described, it will be appreciated by those skilled in the art that changes may be made in these embodiments without departing from the principles and spirit of the invention, the scope of which is defined in the appended claims and their equivalents.

What is claimed is:

1. A refrigerator comprising:

a body having a refrigerating compartment, a freezing compartment, a horizontal insulation partition provided between the refrigerating compartment and the freezing compartment, and an ice making compartment disposed outside the freezing compartment, the refrigerating compartment including a refrigerator door, wherein the refrigerating compartment comprises a refrigerating space forming a refrigerating storing space, a first evaporator space containing a first evaporator for generating cold air and a first blowing fan to introduce cold air into the refrigerating space, the freezing compartment comprises a freezing space forming a freezing storing space, a second evaporator space containing a second evaporator to generate cold air and a second blowing fan to introduce cold air into the freezing space, the ice making compartment is in communication with the second evaporator space via a supply duct to supply cold air from the second evaporator to the ice making compartment, third blowing fan to introduce cold air from the second evaporator into the ice making compartment, and a return duct configured so that circulated air inside the ice making compartment is discharged through an outlet of the return duct and mixed together with circulated air from inside the freezing storing space at a lower region of the second evaporator space, the mixed air flowing through the second evaporator in an upward direction as the mixed air is heat exchanged by the second evaporator before being discharged to the freezing storing space or the supply duct.

2. The refrigerator according to claim 1, wherein the ice making compartment is located within the refrigerating compartment behind the refrigerator door and the supply duct is arranged through an insulation wall of the refrigerator compartment behind the refrigerator door to supply cold air from an outlet of the second evaporator to the ice making compartment.

3. The refrigerator according to claim 1, wherein the supply duct is arranged through an insulation wall of the refrigerator compartment to supply cold air from an outlet of the second evaporator to the ice making compartment.

4. The refrigerator according to claim 2, wherein the return duct is arranged through the insulation wall of the refrigerator compartment to return air from the ice making compartment to an inlet of the second evaporator.

5. The refrigerator according to claim 1, wherein the ice making compartment includes an inlet at a rear surface of the ice making compartment for communicating the ice making compartment to the supply duct and an outlet for communicating the ice making compartment to the return duct, thereby supplying cold air from a rear side to a front side of the ice making compartment.

6. The refrigerator according to claim 1, wherein the third blowing fan comprises a cross-flow fan to supply cold air to the ice making compartment, and the second blowing fan comprises an axial fan to supply cold air to the freezing compartment.

7. The refrigerator according to claim 1, wherein the ice making compartment is located within the refrigerating compartment behind the refrigerator door and the supply duct is arranged outside an insulation wall of the refrigerator compartment behind the refrigerator door to supply cold air from an outlet of the second evaporator to the ice making compartment.

8. The refrigerator according to claim 2, wherein the return duct is arranged outside the insulation wall of the refrigerator compartment to return air from the ice making compartment to an inlet of the second evaporator.

* * * * *

UNITED STATES PATENT AND TRADEMARK OFFICE

CERTIFICATE OF CORRECTION

PATENT NO. : 8,789,388 B2
APPLICATION NO. : 13/709633
DATED : July 29, 2014
INVENTOR(S) : Jong Dal Lee et al.

It is certified that error appears in the above-identified patent and that said Letters Patent is hereby corrected as shown below:

In the Claims

Column 9, Line 36, In Claim 1, before "third" insert -- a --.

Signed and Sealed this
Fourth Day of November, 2014

Michelle K. Lee

Michelle K. Lee
*Deputy Director of the United States Patent and Trademark Office*